US008307982B1

(12) United States Patent
Vovan

(10) Patent No.: US 8,307,982 B1
(45) Date of Patent: Nov. 13, 2012

(54) CAKE CONTAINER COVER-BASE CONNECTION

(75) Inventor: Terry Vovan, Rialto, CA (US)

(73) Assignee: PWP Industries, Inc., Vernon, CA (US)

( * ) Notice: Subject to any disclaimer, the term of this patent is extended or adjusted under 35 U.S.C. 154(b) by 2632 days.

(21) Appl. No.: 10/645,893

(22) Filed: Aug. 18, 2003

(51) Int. Cl.
*B65D 43/10* (2006.01)
*B65D 41/06* (2006.01)

(52) U.S. Cl. ..... 206/467; 426/128; 220/293; 220/298; 220/300

(58) Field of Classification Search ..... 426/106, 426/128; 220/293, 296, 298, 300, 301, 302, 220/669, 671, 212.5, 768, 770; 206/467; 312/284; 215/928, 216, 219, 220, 221, 222
See application file for complete search history.

(56) References Cited

U.S. PATENT DOCUMENTS

| | | | | | |
|---|---|---|---|---|---|
| 235,278 | A | | 12/1880 | Norton | |
| 235,279 | A | * | 12/1880 | Norton | 220/300 |
| 1,515,560 | A | * | 11/1924 | Elwell | 220/300 |
| 1,579,942 | A | * | 4/1926 | Jensvold | 215/329 |
| 1,582,429 | A | * | 4/1926 | Podel | 215/330 |
| 1,619,423 | A | | 3/1927 | Korn | |
| 1,738,893 | A | * | 12/1929 | Grady | 220/301 |
| 2,071,266 | A | * | 2/1937 | Schmidt | 220/301 |
| D156,860 | S | * | 1/1950 | Zaikaner | D7/610 |
| 2,675,040 | A | * | 4/1954 | Raun et al. | 220/298 |
| 2,816,682 | A | * | 12/1957 | Brucker | 220/203.12 |
| 3,070,251 | A | * | 12/1962 | Mangravite | 215/357 |
| 3,351,751 | A | * | 11/1967 | Stube et al. | 362/186 |
| 3,371,817 | A | * | 3/1968 | Gasbarra et al. | 220/298 |
| D214,391 | S | * | 6/1969 | Weiss | D7/553.4 |
| 3,680,745 | A | * | 8/1972 | Landen | 222/570 |
| 3,690,902 | A | * | 9/1972 | Dahl | 426/115 |
| 3,833,147 | A | * | 9/1974 | Borsum et al. | 221/202 |
| 3,844,443 | A | * | 10/1974 | Cudzik | 220/296 |
| 3,854,582 | A | * | 12/1974 | Martinelli | 206/508 |
| 3,931,891 | A | * | 1/1976 | Peppler | 206/538 |
| 4,119,232 | A | * | 10/1978 | Thornton | 215/222 |
| 4,126,224 | A | * | 11/1978 | Laauwe et al. | 206/540 |
| 4,128,184 | A | * | 12/1978 | Northup | 215/222 |
| 4,135,331 | A | * | 1/1979 | Lamlee | 47/61 |

(Continued)

FOREIGN PATENT DOCUMENTS

EP 0818717 B1 7/1997

*Primary Examiner* — Viren Thakur
(74) *Attorney, Agent, or Firm* — Baker Botts LLP

(57) ABSTRACT

A cake container having a base (14) and a transparent cover (16) lying over the base, both being constructed of heat-formed plastic sheets, with peripheries of the base and cover securely latched together in a way that avoids sudden movement during unlatching. The base has a largely vertical peripheral wall (24) forming a plurality of dimples (26), and the cover has a lower peripheral wall (30) with a plurality of dimple-receiving regions (32). Each dimple-receiving region includes a chimney (52) that receives a dimple until the dimple lies at the top portion (60) of the chimney. The cover then can be turned so the dimple enters a dimple-receiving cavity (54) that prevents the cover from moving up off the base until the cover is turned back. The cover has a plurality of vertical ribs (172, 173, 174) forming wide panels (182) and forming narrow panels (180) between the wide panels. Stickers (124) adhere to peripheries of the cover and base to show the customer that there has been no tampering.

5 Claims, 5 Drawing Sheets

U.S. PATENT DOCUMENTS 4,158,983 A * 6/1979 Amico ..... 411/55
4,197,940 A * 4/1980 DeRossett ..... 220/780
4,279,355 A * 7/1981 Schwartz et al. ..... 220/300
4,305,180 A * 12/1981 Schwartz ..... 439/296
4,333,580 A * 6/1982 Sweigart, Jr. ..... 220/4.13
4,375,862 A 3/1983 Kurinsky et al.
4,398,688 A * 8/1983 Williams ..... 244/207
4,434,903 A * 3/1984 Cooke ..... 215/222
4,473,170 A * 9/1984 Ciancimino ..... 220/300
4,516,678 A * 5/1985 Fotiadis et al. ..... 206/308.3
4,671,263 A * 6/1987 Draenert ..... 606/94
4,705,163 A 11/1987 James
4,867,303 A * 9/1989 Beckerman et al. ..... 206/467
4,896,783 A * 1/1990 Leoncavallo et al. ..... 215/330
4,991,811 A * 2/1991 Portnoy ..... 248/346.01
5,072,850 A 12/1991 Gagnon et al.
5,207,345 A * 5/1993 Stewart et al. ..... 220/304
5,273,174 A * 12/1993 Fisher ..... 220/4.21
5,287,959 A * 2/1994 Hansen et al. ..... 220/787
5,320,233 A * 6/1994 Welch ..... 215/252
D352,000 S 11/1994 Hansen et al.
5,529,202 A * 6/1996 Shamis ..... 220/301
D371,964 S * 7/1996 Krupa ..... D9/429
5,542,206 A * 8/1996 Lisch ..... 43/54.1
5,613,607 A * 3/1997 Kalmanides et al. ..... 206/467
5,638,976 A * 6/1997 Arnold ..... 220/298
5,662,233 A * 9/1997 Reid ..... 215/273
5,671,856 A * 9/1997 Lisch ..... 220/4.27
5,711,442 A * 1/1998 Kusz ..... 215/209
5,810,209 A * 9/1998 Foster ..... 222/383.1
5,931,333 A * 8/1999 Woodnorth et al. ..... 220/573.4
5,947,318 A * 9/1999 Palm ..... 220/278
5,975,322 A * 11/1999 Reid ..... 215/273
6,234,338 B1 * 5/2001 Searle ..... 220/366.1
6,595,366 B1 * 7/2003 Brown ..... 206/551
6,662,950 B1 * 12/2003 Cleaver ..... 206/710
6,688,487 B2 * 2/2004 Oakes et al. ..... 220/788
7,198,169 B2 * 4/2007 Silk ..... 220/288
2002/0017525 A1 * 2/2002 Searle et al. ..... 220/366.1
2004/0099548 A1 * 5/2004 Ito et al. ..... 206/303

* cited by examiner

FIG. 4
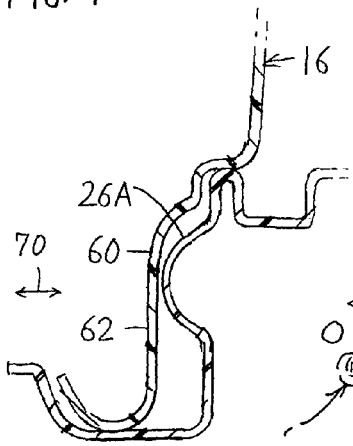
FIG. 5
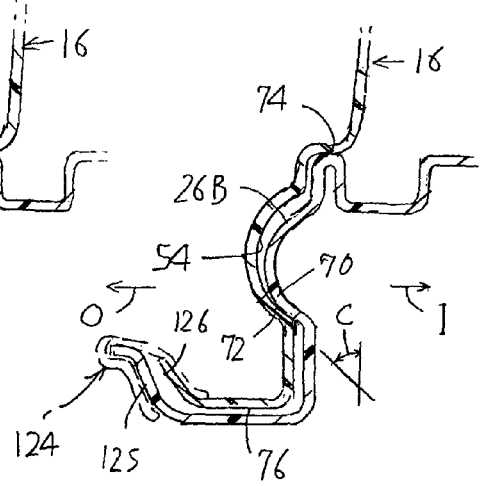
FIG. 6
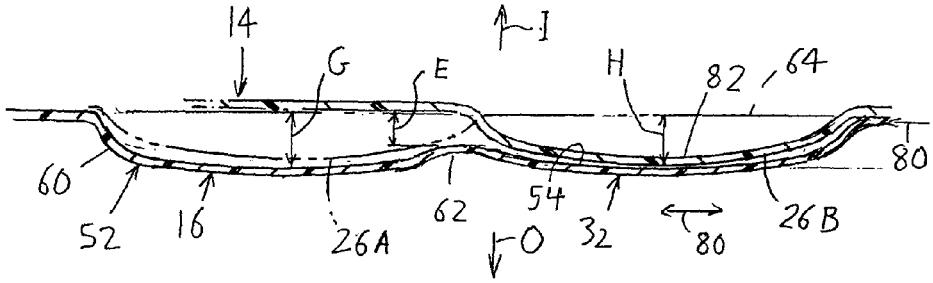
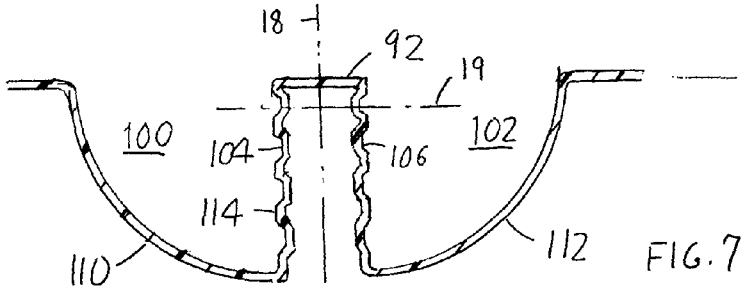
FIG. 7

FIG. 8
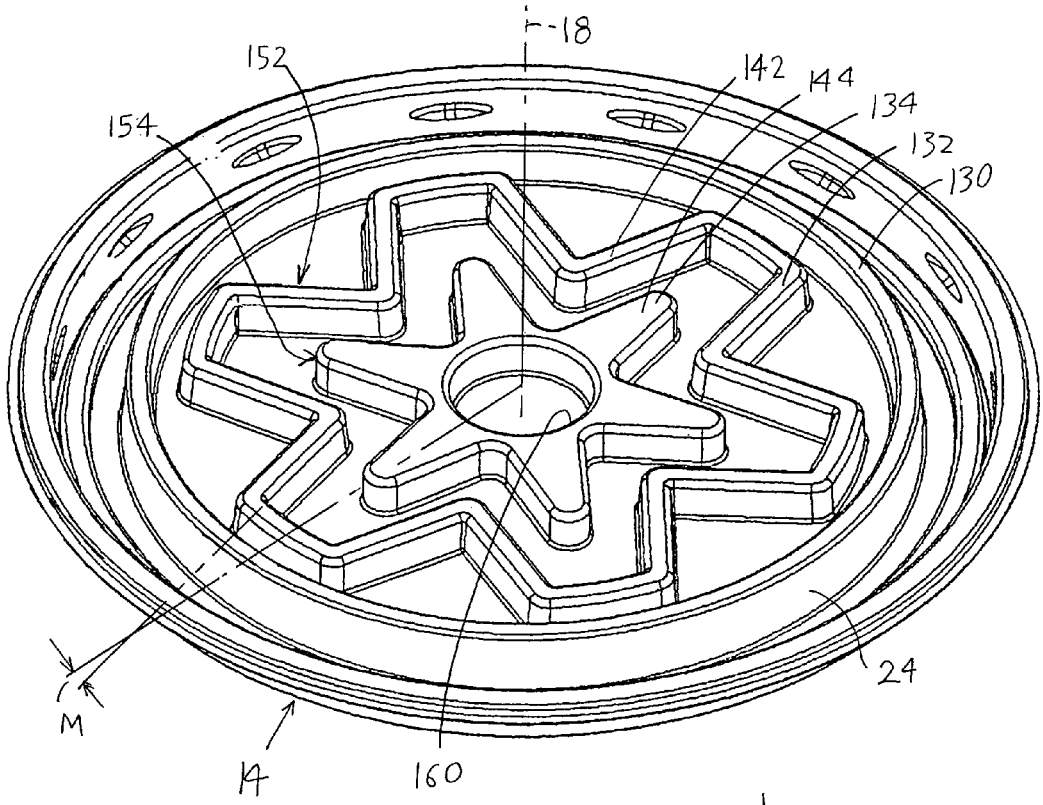
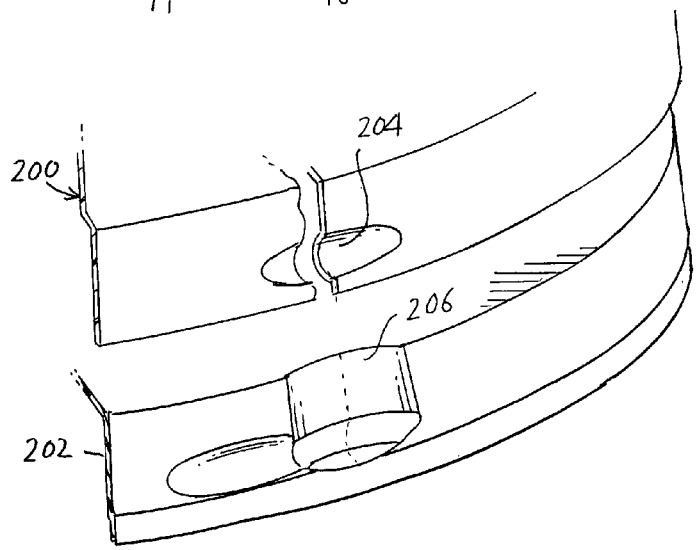
FIG. 9

CAKE CONTAINER COVER-BASE CONNECTION

BACKGROUND OF THE INVENTION

A common type of container for cakes, pies, and other pastries, but especially round (cylindrical) cakes, includes a circular base with a cake-supporting surface, and a largely cylindrical transparent cover that encloses a cake resting on the base. The base and cover are each constructed of a vacuum-formed plastic sheet of a thickness such as 0.2 inch (0.50 mm) and sell in quantities for about 10 cents per container. The cover is commonly held to the base by forming the base with a largely vertical wall having multiple inward projections. The cover is pushed down until the rim of the cover lies under the projections, the projections then resisting upward movement of the cover rim, but allowing such movement when a side of the cover is forcefully raised. One disadvantage of this arrangement is that a considerable upward force is required to lift one side of the cover rim past the base projections, and the lifted side of the cover suddenly moves up as it snaps past the projections. The sudden movement can cause a sudden tilting and/or sideward movement of the container or cover, and possibly damage the icing on the case. An apparatus that latched the cover to the base in a manner that allowed a "smoother" unlatching, would avoid possible damage to the icing of the cake.

Many customers are concerned that someone may have tampered with a cake they are considering buying, by lifting an edge of the cover and wiping a finger across the icing to taste the icing. It would be desirable if a customer could be assured that this has not happened.

The container cover usually includes a largely cylindrical wall of a height of a plurality of inches, and a top wall, with the walls being transparent. In order to strengthen the side walls against column-like collapse when a plurality of cake-holding containers are stacked one on another, the cover side walls are formed with inward projections or ribs that are spaced apart by about ½ inch around the cover circumference, with the panels having sharp curves. While the cake can be seen through the narrow panels with sharp curves, the view is distorted. It would be desirable if a customer had a less distorted view of the cake.

SUMMARY OF THE INVENTION

In accordance with one embodiment of the present invention, a cake container is provided which enables secure latching and unlatching of a cover member to a base member, while assuring customers that the container has not been tampered with and providing a good view of the cake. The base and cover members are each sheets of plastic that have been heat formed. One of the container members such as the base, has a largely vertical cylindrical wall with a plurality of dimples formed in the wall. The other member such as the cover, has a largely vertical wall with dimple-receiving regions that receive the dimples. The dimple-receiving regions each forms a chimney about as wide as one of the dimples to receive the dimple when the cover is lowered onto the base. Each dimple-receiving region also has a dimple-receiving cavity connected to the upper end of the chimney, so that after the cover has been pushed over the base, the cover can be turned to move each dimple cavity so it receives a dimple. Thereafter, the dimples cannot fall out of the dimple cavities because the dimple cavities have walls lying under the dimples.

When a cake or other pastry lies in the container and the cover has been latched to the base, stickers are attached to the container. Each sticker has one portion bonded to a cover and another portion bonded to the base. This assures a customer that the cake has not been tampered with.

The largely cylindrical vertical cover wall has multiple vertical ribs, with panels between pairs of adjacent ribs, to strengthen the cover against column-like collapse when a plurality of cake-holding containers are stacked. The panels are of different widths, and include wide panels, of a width of at least 1.25 inch to provide a clear view, and narrow panels of less than half the width of the wide panels lying between the wide panels.

The tope wall of the cover has a pair of depressions forming a handle arrangement for turning the cover with one hand. The base is formed with a plurality of largely radially-extending channels with upper ends that support a cake. The channels are connected together to form a star with at least four star projections. The middle of the base has a recess to accommodate labels on the underside of a cardboard sheet lying under a cake.

The novel features of the invention are set forth with particularity in the appended claims. The invention will be best understood from the following description when read in conjunction with the accompanying drawings.

DESCRIPTION OF THE DRAWINGS

FIG. 4 is a sectional view taken on line 4-4 of FIG. 2, after the cover has been moved down onto the base, but before the cover is turned to latch the cover to the base.

FIG. 5 is a view taken on line 5-5 of FIG. 2, after the cover has been turned so each dimple lies in a dimple-holding cavity of the cover.

FIG. 6 is a sectional view taken on line 6-6 of FIG. 2, with a dimple shown lying in the dimple-holding cavity and showing, in phantom lines, the dimple lying in the upper end of the chimney.

FIG. 7 is a view taken on line 7-7 of FIG. 1.

FIG. 8 is a top isometric view of the base the container of FIG. 1.

FIGS. 9, 10 and 11 are each an exploded partial isometric view of a cake container of a different embodiment of the invention.

DESCRIPTION OF THE PREFERRED EMBODIMENTS

Figure 1:
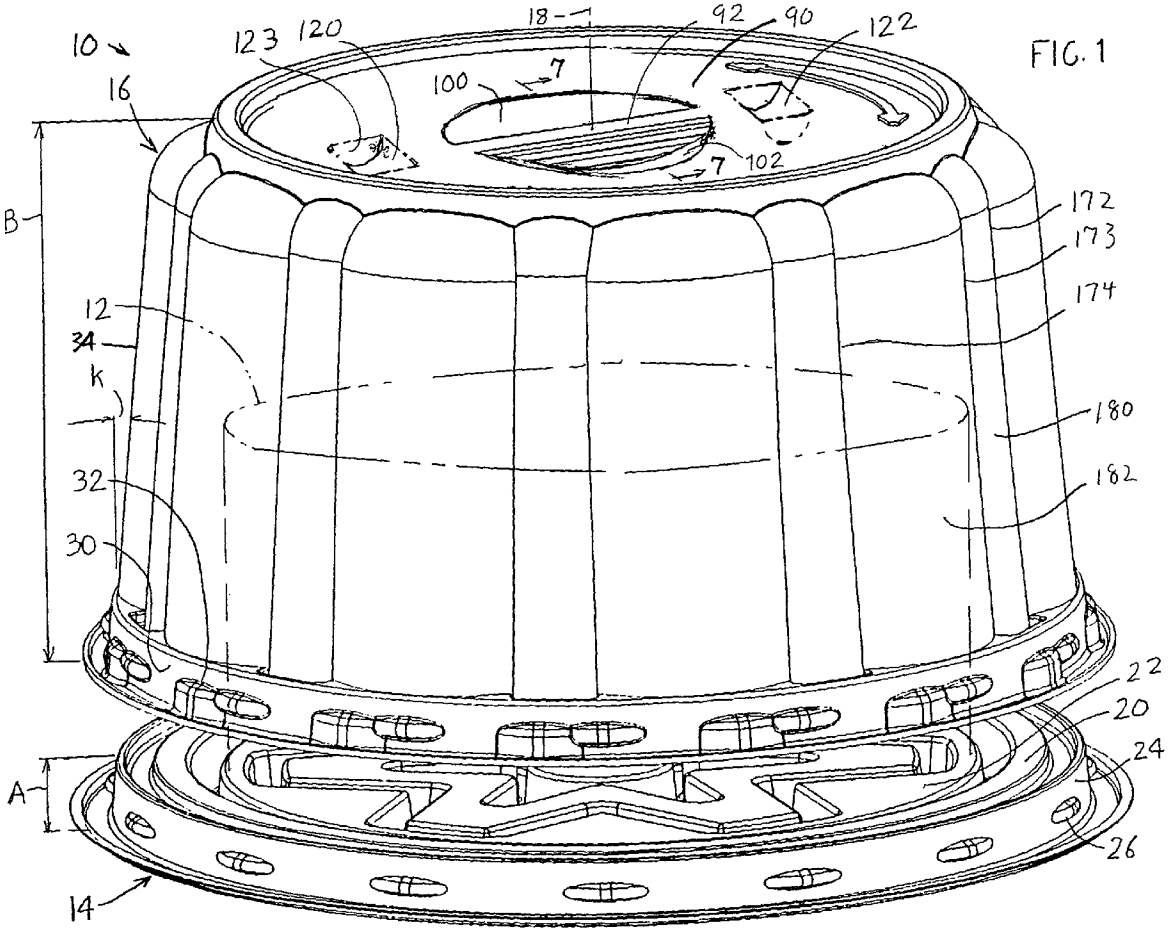
FIG. 1 is an exploded isometric view of a cake container of the present invention, with a cake therein shown in phantom lines.

FIG. 1 illustrates a cake container 10 for holding pastries, with the most common type of pastry held in the particular container being a round, or cylindrical, cake 12. The container includes a base 14 and a cover 16, both centered on a vertical container axis 18. The base has a small height A such as 0.4 inch, while the cover has a much greater height B such as 4 inches for holding a full-sized cake. The base has an outer cake-supporting surface 20 and one or more inner cake-supporting surfaces such as 22. A largely vertical, cylindrically-shaped base peripheral wail 24 is provided, which has a plurality of outwardly-projecting dimples 26. The cover has a lower portion with a largely vertically-extending cover lower cylindrical wall 30 that forms a plurality of dimple-receiving regions 32 that each receives one of the dimples 26. The illustrated container has a diameter of about 10.5 inches at the periphery of the base, to hold a cake 12 of a diameter of about 8 inches. A cover largely cylindrical wall 34 that extends along most of the height of the cover, is tapered at a small angle K of about 6° for easier manufacture.

The base 14 and cover 16 are each constructed of heat-deformed sheet plastic, having a thickness on the order of magnitude of 0.020 inch (0.5 mm). The dimples 26 are produced by outwardly-deforming areas of the base wall 24, and the dimple-receiving regions 32 are also formed by outwardly-deforming regions of the cover at lower wall 30. For the container of FIG. 1, there are fourteen dimples 26 and fourteen corresponding dimple-receiving regions 32.

Figure 2:
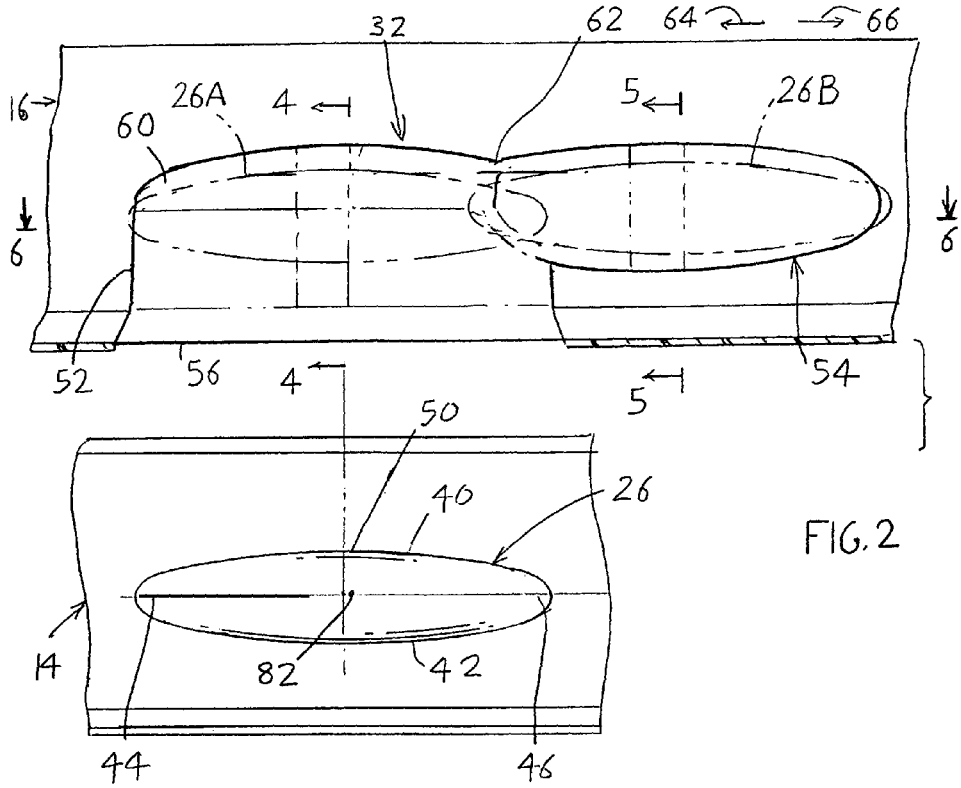
FIG. 2 is an enlarged exploded view of a portion of the cover and a portion of the base of the container of FIG. 1.
Figure 3:
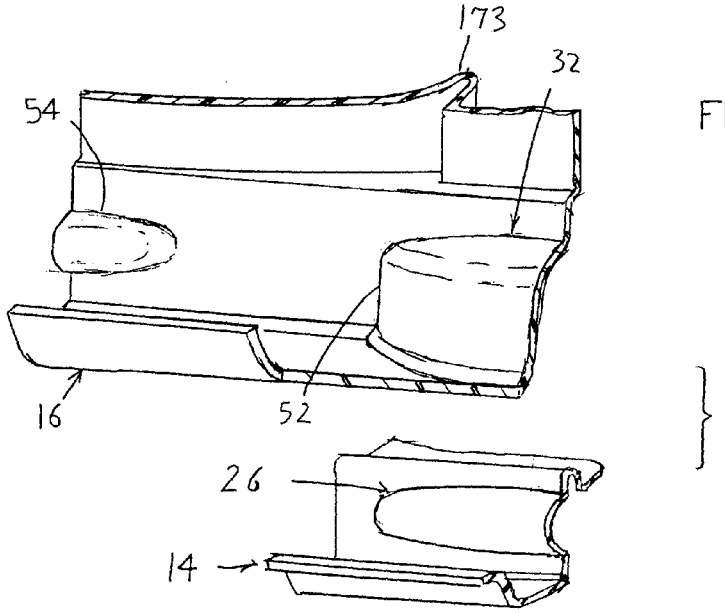
FIG. 3 is a partial exploded isometric view of a portion of the cover and base of FIG. 2.

FIGS. 2 and 3 are enlarged views of a dimple 26 and of a dimple-receiving region 32. Each dimple has top and bottom edges 40, 42 that are convexly curved, to leave end portions 44, 46 of much smaller height than the middle 50. Each dimple-receiving region 32 of the cover includes a chimney 52 and a dimple-receiving cavity 54. The lower end 56 of the chimney is the entrance end that initially receives the dimple. The upper portion 60 of the chimney connects to the dimple-receiving cavity 54 through a horizontally-extending transition location 62.

To latch the cover 16 to the base 14, the cover is lowered so the dimple enters the chimney 52, until the dimple lies in the chimney upper portion 60. The cover 16 is then rotated along the direction of arrow 64, so the dimple-receiving cavity 54 moves around the dimple to hold the dimple at the position 26B. Another way to describe the process is that the dimple 26 moves upward, relative to the cover, to the position 26A in the chimney upper portion 60. Then, the dimple moves in the direction of arrow 66 past a transition location 62 to the cavity 54, the dimple then lying at a position 26B in the cavity. In actuality, the base 14, which usually has a cake or other heavy pastry on its support surfaces, remains stationary and only the cover is moved.

FIG. 4 shows the dimple at 26A lying in the chimney upper portion 60. FIG. 5 shows a container wherein the dimple at 26B lies in the dimple-receiving cavity 54. A lower portion 70 of the dimple forms a largely downwardly-facing shoulder that abuts a corresponding largely upwardly-facing shoulder in the lower portion 72 of the cavity walls of the dimple-receiving cavity 54. This prevents the cover 16 from moving upward, therefore, the cover and base are latched together. The cover 16 cannot move downward because of engagements at 74 and 76 of the cover and base.

It can be readily seen from FIGS. 4 and 5 that the cover and base are formed of thin plastic sheets. Such plastic sheets are resilient because they can bend when a moderate force is applied. As a result, large tolerances are acceptable, while still assuring that the dimple can move in the chimney and into and out of the dimple-receiving cavity. Nevertheless, the dimple is prevented from moving downward with respect to the walls of the dimple-receiving cavity 54 as shown in FIG. 5. It is noted that the lower portions 70, 72 of the dimple and of the cavity, are angled by angles indicated at C that are many degrees (over 15° and preferably 45°) from the vertical and from the horizontal. As a result, the lower portions 70, 72 can still engage their shoulders to prevent the cover from being pulled up despite large tolerances in manufacture, while allowing relative sliding by slight deflection of the dimple radially inwardly I, or deflection of the walls of the cavity lower portion deflecting outward O slightly with respect to the container axis.

FIG. 6 shows that at the transition location 62, the radial distance E between the cover 16 and the base 14 is reduced from the distance G and the distance H with respect to a circle 64 centered on the container axis. The dimple-receiving region 32 of the cover moves in a cylindrical path indicated by arrows 80. The middle 82 of the dimple must deflect radially inwardly I and/or the transition location 62 on the cover must deflect radially outwardly O in order for the dimple to pass from the cavity 54 to the chimney upper portion 60. As a result, a considerable torque, but of a level that can be readily applied by a person's hand, is required to rotate the cover with respect to the base, in order to unlatch and remove the cover.

FIG. 1 shows that the cover has a cover top 90 that forms a handle 92. The handle can be grasped by a hand, to turn the cover, to latch or unlatch it from the base. The handle is formed by two depressions 100, 102 in the cover top, with the handle 92 formed between the depressions. As shown in FIG. 7, the handle 92 has primarily vertical opposite side walls 104, 106 that can be squeezed between the thumb and the index or middle fingers. The rest of the recesses 100, 102 form curved walls 110, 112. Applicant prefers to provide ridges 114 in the sides of the handle, for better gripping.

FIG. 1 also shows, in phantom lines, a pair of recesses 120, 122 that can be formed in the cover top 90, each recess having primarily vertical end walls 123. A person can turn the cover with one hand, by placing a thumb in one recess such as 120 and the index and middle fingers in the other recess 122 to turn the cover in either direction. The wide separation, preferably at least three inches, between the recess allows a large torque to be easily applied. It is useful to be able to turn the cover with one hand, because this allows a person to hold the base 14 from turning with his/her other hand. Applicant notes that for handle 92 of FIG. 7, the handle side are primarily normal to a radial line 19, while for recesses 120, 122 in FIG. 1 the pushing surfaces face primarily circumferential and are primarily parallel to a radial line.

FIG. 5 shows, in phantom lines, a sticker 124 that is bonded to adjacent portions 125, 126 of the base and cover, at their radially outer edges. Applicant prefers to attach a plurality of circumferentially-spaced stickers to the base and cover outer edges. The sticker(s) assure a potential buyer that no one has opened the container, as to taste the icing. Each sticker can be a paper or thin plastic member with contact adhesive that bonds it to the base and cover.

FIG. 8 shows that the base 14 has upwardly-deformed projections 130, 132, 134 within the dimple-forming wall 24. The walls 24, 130 are circular and centered on the container axis 18. The two other projections 132, 134 form upstanding channels such as 142, 144 with opposite sides that extend at small angles M to the radial so they extend primarily radial to the container axis 18. Each of the groups of channels 142, 144 forms a star 152, 154, with each star illustrated having six points, and with the points of the smaller star projecting into the points of the larger star. The opposite sides of each channel help to stiffen the base against upward or downward deflection. Previously, applicant used only circular channels, similar to channel 132, but of different diameters, to strengthen the base. The channels with largely radially-extending sides provide additional rigidity, to minimize bending when the base is loaded with a heavy cake.

The center of the base has a small circular recess 160, of a diameter of about 1 inch, and preferably between ½ and 2 inches. A cardboard sheet lying under a cake commonly has nutrition information on a label pasted to the center of the sheet underside. The presence of the recess 160 results in such a label not being marked or torn when the cardboard sheet is shifted back and forth with a cake on it, even if some material (e.g. chocolate sprinkles) has fallen onto the center of the base. A recess diameter more than about 2 inches begins to weaken the base, while a recess diameter less than about ½ inch cannot readily receive a label, which is commonly about 1 inch in diameter.

FIG. 1 shows that the primarily vertical side wall 34 of the cover has numerous primarily vertical ribs such as 172, 173, 174, and panel portions or panels 180, 182 between pairs of adjacent flutes, or ribs. When the ribs are inclined from the vertical (but still primarily vertical) they are often referred to as "swirls". The ribs strengthen the side wall against column collapse, as when many cakes are stacked. However, the ribs block a side view of the pastry by a potential customer. Applicant spaces the ribs to provide wide panels 182 spaced apart by (one or more) narrow panels 180. The strength of the side wall is reduced only slightly by the presence of the wide panels. However, applicant finds that customers shift their eye position slightly in order to view the cake through a wide panel 182. The wide panels 182 should have a width of at least 1.25 inch, and preferably at least 1.5 inches, to provide an adequate view. The narrow panels 180 are no more than half as wide as the wide panels 182. The presence of wide panels is especially useful when the top wall of the cover is partially blocked as in FIG. 1, or the cake lies on a shelf that is as high as a person's chest. Applicant notes that the primarily vertical ribs can be angled from the vertical and can merge with curved top and bottom primarily horizontal ribs to create a "swirl" effect. Nevertheless, it is the primarily vertical ribs that strengthen the sheet plastic cover walls against column collapse.

Figure 10:
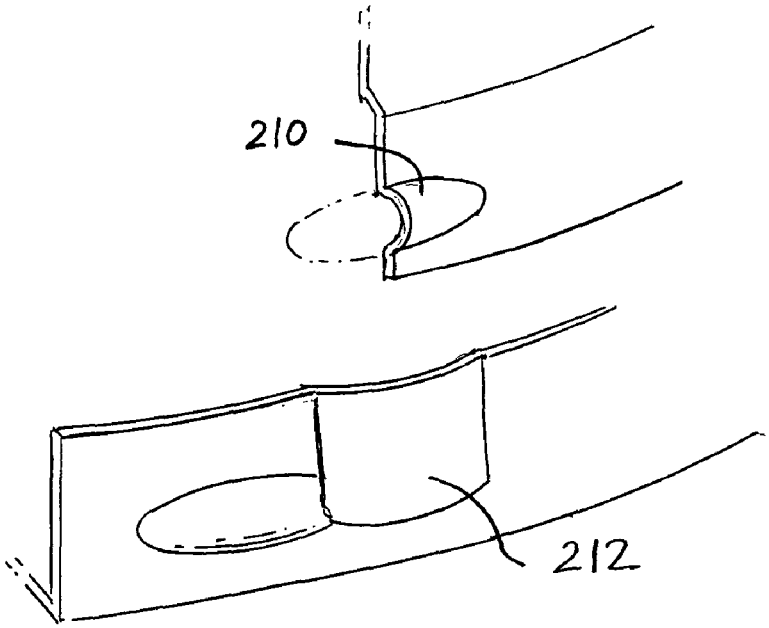
Figure 11:
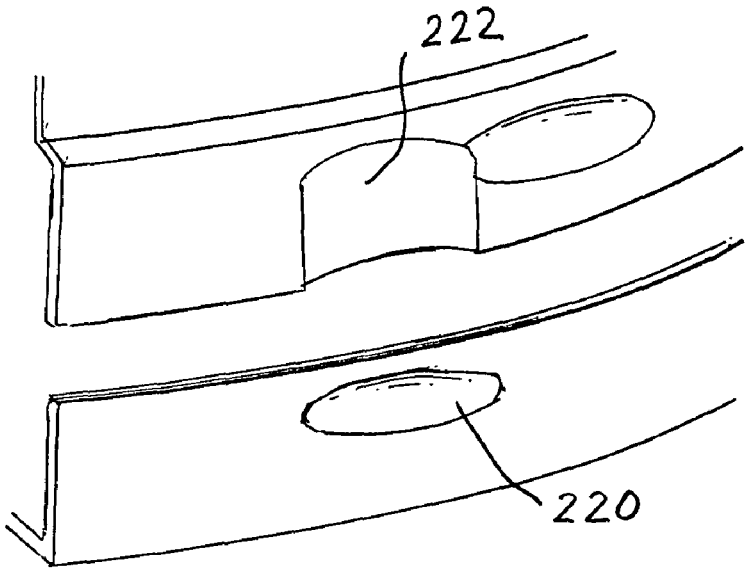

FIGS. 1-8 show a cover bottom surrounding a base wall, and show dimple-receiving regions 32 as radially outward deflections in the bottom of the cover and show the dimples 26 as radially outward projections in the base. However, other constructions can be used. FIG. 9 shows a cover 200 with a lower end that surrounds a base wall 202, with inward deformations forming a dimple 204 in the cover and a dimple-receiving region 206 in the base. FIG. 10 shows outward projections, including a dimple 210 in the cover and a dimple-receiving region 212 in the base. FIG. 11 shows inward projections, including a dimple 220 in the base and a dimple-receiving 222 region in the cover. Applicant prefers the arrangement of FIGS. 1-8 and 9, in which the cover surrounds the base wall and avoids open pockets into which material may fall.

Thus, the invention provides a container for pastries, and especially for a cylindrical cake, which enables the cover to be latched to the base and later unlatched in a smooth manner that avoids sudden jolts that can cause the cover to move against one side of the cake and harm the cake icing. This is accomplished by forming dimples in one of the cover members such as the base and forming dimple-receiving regions in the other member such as the cover. Each dimple-receiving region includes a chimney with an entrance end that receives a dimple moving to the opposite portion of the chimney, and which includes a dimple-receiving recess horizontally connected to the chimney portion to receive the dimple when the cover is turned, to prevent separation of the cover and base. Stickers can be attached to adjacent peripheral portions of the cover and base to show that the container has not been tampered with after the cake was placed on the container (and the stickers were applied). The cover has a top wall with deformations forming a handle arrangement. One handle arrangement is formed by a single handle with closely-spaced recesses on opposite sides. Another handle arrangement is formed by two widely spaced recesses on opposite sides of the container axis, for each receiving a finger of a single hand to turn the cover. The cover has ribs and has panels extending between ribs, and includes wide, panels and narrow panels between the wide panels to provide strength for the cover and yet to provide wide panels to readily view the contents of the container. The base has upward deformations that form stars with opposite sides extending largely radially to stiffen the base.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A cake container for holding cake or other food which includes a base (14) lying on a vertical container axis (18), said base having a cake-supporting base surface (20) and having a largely cylindrical base peripheral wall (24) centered on said container axis and extending around said cake-supporting base surface, said cake container also including a cover (16) that has a greater height than said base and that has a largely cylindrical cover peripheral wall (30) centered on said container axis, wherein:

said base peripheral wall has a plurality of radially outwardly-projecting dimples (26);

said cover peripheral wall has a plurality of dimple-receiving regions (32) each formed by a radially-outward deformed region of said cover peripheral wall, said dimple-receiving regions each having a chimney (52) about as wide as one of said dimples to receive a dimple in a chimney upper portion (60) by the cover being lowered around the base while chimney lower ends initially lie directly over said dimples;

said dimple-receiving regions each having a dimple-receiving cavity (54) connected to one of said chimney upper portions to receive one of said dimples when the cover is turned about said cover axis after the dimple has reached said chimney upper portion;

said base and said cover are each formed of a resilient plastic sheet of a thickness on the order of 0.020 inch that has been deformed, and walls of said dimple-receiving regions and said dimples each can deflect radially to assure that the dimples can be received in the dimple-receiving regions despite tolerances in manufacture, and said cover is formed of a transparent plastic sheet, whereby to allow a person to view a dimple as it moves in a dimple-receiving region.

2. The cake container described in claim 1, wherein:

said dimple-receiving cavities each have a transition location (62) between its chimney upper portion (60) and a dimple-holding cavity (54), said transition location forming a resilient narrowing through which the corresponding dimple must pass and that provides resistance to dimple movement between the dimple holding cavity and the chimney upper portion.

3. The cake container described in claim 2 wherein:

said narrowing is in a radial direction (0, I) of the transition location with the radial direction being a direction radial to said vertical container axis.

4. A cake container for holding a cake or other food, which includes a base member (14) of a formed first plastic sheet on which the food lies and a transparent cover member (16) of a formed second plastic sheet that is transparent to allow a buyer to see the food, said base and cover member being centered on a vertical axis (18), wherein:

a first of said members (14, 16) forms a plurality of dimples (26) in its plastic sheet, each dimple having inner and outer surfaces with one surface forming a projection and the other surface forming a recess;

a second of said members forms a plurality of vertically extending hollow chimneys (52) that each receives the projection of one of said dimples, said second member also forms dimple-receiving cavities (54) each with a wall (42) that prevents a dimple from moving in a vertical direction that would disconnect the members, each dimple constructed to pass from one of said chimneys into one of said dimple-receiving cavities when said cover is turned about said axis, the plastic sheets of said members being deflectable to enable close reception of each dimple in a dimple-receiving cavity by radial deflection (I, 0) of the members;

said second member forms a transition location (62) between each chimney and each corresponding dimple-receiving cavity, each transition location has a constriction to resist turning of said cover on said base to move one of said dimples through the constriction into one said chimneys.

5. The cake container described in claim 4, wherein:

each of said dimple-receiving cavities has a maximum radial depth (G), and each of said transition locations has a smaller radial depth (E) than the maximum radial depth of a dimple-receiving cavity.

* * * * *